US007507513B2

(12) United States Patent
Tong et al.

(10) Patent No.: US 7,507,513 B2
(45) Date of Patent: Mar. 24, 2009

(54) TONER COMPOSITION

(75) Inventors: Yuhua Tong, Webster, NY (US); Chieh-Min Cheng, Rochester, NY (US); Louis V. Isganitis, Rochester, NY (US); Eunhee Lee, Honeoye Falls, NY (US); Zhen Lai, Webster, NY (US)

(73) Assignee: Xerox Corporation, Stamford, CT (US)

( * ) Notice: Subject to any disclaimer, the term of this patent is extended or adjusted under 35 U.S.C. 154(b) by 504 days.

(21) Appl. No.: 11/301,552

(22) Filed: Dec. 13, 2005

(65) Prior Publication Data

US 2007/0134577 A1 Jun. 14, 2007

(51) Int. Cl.
*G03G 9/08* (2006.01)

(52) U.S. Cl. ..... 430/108.1; 430/110.1; 430/137.14

(58) Field of Classification Search ..... 430/108.1, 430/137.14, 110.1
See application file for complete search history.

(56) References Cited

U.S. PATENT DOCUMENTS

| | | | |
|---|---|---|---|
| 2,874,063 | A | 2/1959 | Greig |
| 3,590,000 | A | 6/1971 | Palermiti et al. |
| 3,655,374 | A | 4/1972 | Palermiti et al. |
| 3,720,617 | A | 3/1973 | Chatterji et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,265,990 | A | 5/1981 | Stolka et al. |
| 4,394,430 | A | 7/1983 | Jadwin et al. |
| 4,497,885 | A | 2/1985 | Ushiyama et al. |
| 4,560,635 | A | 12/1985 | Hoffend et al. |
| 4,563,408 | A | 1/1986 | Lin et al. |
| 4,584,253 | A | 4/1986 | Lin et al. |
| 4,858,884 | A | 8/1989 | Harwath |
| 4,935,326 | A | 6/1990 | Creatura et al. |
| 4,937,166 | A | 6/1990 | Creatura et al. |
| 5,215,854 | A | 6/1993 | Yamazaki et al. |
| 5,227,460 | A | 7/1993 | Mahabadi et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,853,943 | A | 12/1998 | Cheng et al. |
| 5,965,316 | A | 10/1999 | Kmiecik-Lawrynowicz et al. |
| 6,004,714 | A | 12/1999 | Ciccarelli et al. |

(Continued)

*Primary Examiner*—John L Goodrow
(74) *Attorney, Agent, or Firm*—Carter, DeLuca, Farrell & Schmidt, LLP

(57) ABSTRACT

Copolymer encapsulated wax particles and their use in forming toner compositions having particles with a desired circularity and size are provided.

8 Claims, 1 Drawing Sheet

U.S. PATENT DOCUMENTS 6,190,815 B1 2/2001 Ciccarelli et al.
6,447,971 B2 9/2002 Takezawa et al.
6,506,532 B2 1/2003 Akai et al.
6,602,644 B2 8/2003 Matsushima et al.
6,610,453 B2 * 8/2003 Akai et al. ..... 430/108.3
6,720,123 B2 4/2004 Xu et al.
6,921,619 B2 7/2005 Ohmura et al.
7,344,813 B2 * 3/2008 Sweeney et al. ..... 430/108.2
7,378,214 B2 * 5/2008 Lee et al. ..... 430/137.15

* cited by examiner

TONER COMPOSITION

BACKGROUND

The present disclosure relates generally to toners and toner processes, and more specifically, to toner compositions containing an encapsulated wax.

In electrophotography, an image is produced by forming an electrostatic latent image on a surface of a photoreceptor having a drum or belt shape, or the like, developing the electrostatic latent image with a toner so as to obtain a toner image, electrostatically transferring the toner image onto a recording media such as paper directly or via an intermediate transfer member, and fusing the toner onto a surface of the recording paper by heating, or the like.

A narrow distribution of particle size of toner is desirable for use in image forming devices. When the distribution of particle size is wide, the ratio of toner having a small particle size relative to toner having a large particle size, or vice versa, may be increased. This may cause certain problems in the case of a two-component developing agent including a toner and a carrier. For example, where toner possesses a greater amount of small particles, the toner can easily adhere to the carrier and thus the ability of the carrier to retain a charge is deteriorated. In contrast, in the case of toner wherein there is a greater amount of large particles, there are problems such as a tendency for image quality deterioration because of inefficiency in the transfer of toner onto a recording media.

Toner of narrow particle size distribution can be produced by emulsion aggregation methods. Methods of preparing an emulsion aggregation (EA) type toner are known and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. In particular, the '943 patent describes a process including: (i) conducting a pre-reaction monomer emulsification which includes emulsification of the polymerization reagents of monomers, chain transfer agent, a disulfonate surfactant or surfactants, and optionally, but in embodiments, an initiator, wherein the emulsification is accomplished at a low temperature of, for example, from about 5° C. to about 40° C.; (ii) preparing a seed particle latex by aqueous emulsion polymerization of a mixture including (a) part of the monomer emulsion, from about 0.5 to about 50 percent by weight, or from about 3 to about 25 percent by weight, of the monomer emulsion prepared in (i), and (b) a free radical Initiator, from about 0.5 to about 100 percent by weight, or from about 3 to about 100 percent by weight, of the total initiator used to prepare the latex polymer at a temperature of from about 35° C. to about 125° C., wherein the reaction of the free radical initiator and monomer produces the seed latex comprised of latex resin wherein the particles are stabilized by surfactants; (iii) heating and feed adding to the formed seed particles the remaining monomer emulsion, from about 50 to about 99.5 percent by weight, or from about 75 to about 97 percent by weight, of the monomer emulsion prepared In (ii), and optionally a free radical initiator, from about 0 to about 99.5 percent by weight, or from about 0 to about 97 percent by weight, of the total Initiator used to prepare the latex polymer at a temperature from about 35° C. to about 125° C.; and (iv) retaining the above contents in the reactor at a temperature of from about 35° C. to about 125° C. for an effective time period to form the latex polymer, for example from about 0.5 to about 8 hours, or from about 1.5 to about 6 hours, followed by cooling. Other examples of emulsion/aggregation/coalescing processes for the preparation of toners are illustrated in U.S. Pat. Nos. 5,290,654, 5,278,020, 5,308,734, 5,370,963, 5,344,738, 5,403,693, 5,418,108, 5,364,729, and 5,346,797, the disclosures of each of which are hereby incorporated by reference in their entirety. Other processes are disclosed in U.S. Pat. Nos. 5,348,832, 5,405,728, 5,366,841, 5,496,676, 5,527,658, 5,585,215, 5,650,255, 5,650,256 and 5,501,935, the disclosures of each of which are hereby incorporated by reference in their entirety.

Some toners include a wax to assist in toner release from the fuser roll during the fusing process. In some current emulsion aggregation processes, a core latex, pigment dispersion and wax dispersion are mixed at the beginning of the toner formation process. When wax is mixed with a core latex and pigment dispersion at the beginning of aggregation and coalescence, the wax particles may become physically trapped in the mixture and act as spacers preventing the aggregation of resin particles and pigment particles. This may increase the process time for aggregation and coalescence which, in turn, may result in a longer process time. This increase in process time may contribute to the high cost of EA produced toner.

Most waxes utilized in the formation of EA toner are linear polymeric waxes, such as linear polyethylenes with a number average molecular weight of about 800 and a molecular weight distribution of about 1.1. These linear waxes may not be compatible with polymer resins utilized in toners forming a separate wax domain when incorporated into toners. These separate wax domains may become trapped in toner particles at various locations throughout the toner particles. For example, the wax particles may be trapped inside the core of a toner particle and lose their ability to function during the fusing process. Other wax particles may migrate and present themselves on the surface of toner particles, which may cause low toner flowing and transferring problems. In addition, large wax particles may form during storage, which eventually increases the size of toner particles. Attempts to remove such wax particles, such as by filtration, may result in undesirable variations in the wax content of the toner. Moreover, wax dispersions utilized in forming such toners may be unstable, which can result in large wax particle size, and high wax concentrations may be needed to obtain desired fusing performance.

Work is continuing on methods for improving the incorporation of wax into toner particles. For example, U.S. Pat. No. 5,965,316, the disclosure of which is hereby incorporated by reference in its entirety, uses a wax dispersion in water as a seed to form encapsulated wax particles, which are utilized in an emulsion/aggregation/coalescence process to form toner.

After the aggregation/coalescence process, high molecular weight wax may still be trapped inside the core of the toner particles and lower molecular weight wax may be on the surface of the toner particles. This can lead to various problems. For example, wax that is buried deep in the core of a toner particle does not contribute as much to the release function during the fusing process. Wax exposed at the toner particle surface can interfere with additive blending and reduce the time the toner may be stored before use. Thus, the ideal position of wax in toner particles is in the shell of the toner, near the surface of the particle.

Improved methods for producing toner, which reduce the time for the EA process and thus the cost, and are capable of utilizing existing processing equipment and machinery, remain desirable.

SUMMARY

The present disclosure provides processes for producing copolymer encapsulated wax particles. The process includes contacting a wax dispersion, at least two monomers, a surfactant, and a stabilizer of the following formula:

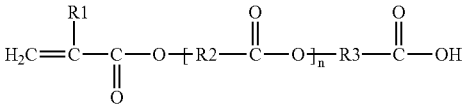

(I)

where R1 is hydrogen or methyl group; R2 and R3 are independently selected from alkyl groups containing about 1 to about 12 carbon atoms and a phenyl group; and n is from about 0 to about 20. The copolymer encapsulated wax particles are formed by emulsion polymerization of the monomers and stabilizer to form a copolymer shell around a wax core and recovering the encapsulated wax particles. In embodiments, the wax utilized in the wax dispersion possesses side chains.

The present disclosure also provide toners comprising these encapsulated wax particles in combination with a colorant and optionally one or more components selected from the group consisting of surfactants, coagulants, waxes, surface additives, and optionally mixtures thereof.

In embodiments, the process may include contacting a wax dispersion, at least two monomers, a surfactant, and a stabilizer of the following formula:

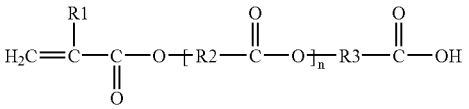

(I)

where R1 is hydrogen or methyl group, R2 and R3 are independently selected from alkyl groups containing 1 to 12 carbon atoms and a phenyl group, and n is from about 0 to about 20. The copolymer encapsulated wax particles are formed by emulsion polymerization of the monomers to form a copolymer shell around a wax core and recovering the copolymer encapsulated wax particles. The process may further include aggregating the copolymer encapsulated wax particles with a colorant and optionally one or more components selected from the group consisting of surfactants, coagulants, waxes, surface additives, and optionally mixtures thereof to form aggregated toner particles, coalescing the aggregated toner particles to form aggregated and coalesced toner particles, and washing the aggregated and coalesced toner particles to form toner.

The present disclosure also provides compositions including particles including a wax comprising a core and a copolymer shell encompassing the core thereby forming copolymer encapsulated wax particles, wherein the wax binds to monomers comprising the copolymer shell.

The branched waxes utilized in the processes and compositions of the present disclosure may include branched polyolefins, branched vegetable waxes, branched animal waxes, branched mineral waxes and branched synthetic waxes, and the monomers utilized to form the copolymer shell may include styrenes, acrylates, methacrylates, butadienes, isoprenes, acrylic acids, methacrylic acids, acrylonitriles, and mixtures thereof.

BRIEF DESCRIPTION OF THE DRAWINGS

Various embodiments of the present disclosure will be described herein below with reference to the figures wherein.

DETAILED DESCRIPTION

Figure 1:
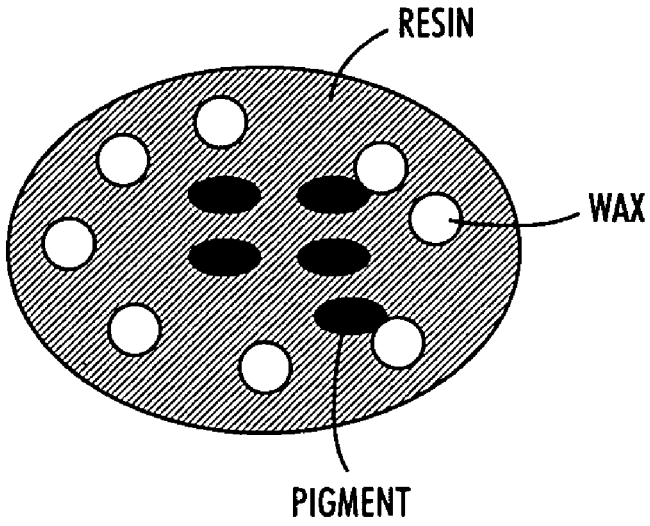
FIG. 1 schematically shows a toner particle of the present disclosure including wax encased by a latex.

In accordance with the present disclosure, toner compositions are provided which include toner particles having a narrow range of particle size and particle circularity. Toners produced in accordance with the present disclosure utilize particles including a shell latex with a wax core, in combination with a colorant and one or more additives such as surfactants, coagulants, surface additives, optionally mixtures thereof, and the like. Toner particles prepared with the particles of the present disclosure possess wax particles in the shell of the toner, where they can assist in the fusing process. The wax, however, does not protrude from the shell, thereby enhancing aggregation and reducing particle size distribution of the toner and resulting in more uniform circularity of the toner particles.

The particles of the present disclosure can be prepared utilizing current emulsion polymerization processes, including semi-continuous emulsion polymerization, using waxes as seeds in the formation of the emulsion particles of the present disclosure.

Waxes which may be used in forming particles of the present disclosure may have a branched or amorphous configuration. As used herein a "branched wax" may refer in embodiments, for example, to a wax having linear main macromolecular chains with pendant side chains which can be either the wax or a functional group such as hydroxyl, carboxyl, amino, amido, ester, ether, ammonium and/or halogen. Such waxes include, for example, an amorphous polyolefin or a branched polyolefin wax. Other waxes which may be utilized according to embodiments of the present disclosure include natural vegetable waxes, natural animal waxes, mineral waxes and/or synthetic waxes having a branched or amorphous configuration. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, pentaerythritol tetrastearate, polyolefin waxes such as polyethylene wax and polypropylene wax, and mixtures thereof. Other branched waxes include, for example, polyester waxes, hyperbranched polymeric waxes such as hyperbranched polypropylene derivatives, and gradient branched waxes such as grafted copolymers of ethylene and propylene.

Polyolefin waxes which may be used in the present disclosure may be saturated, non-polar, synthetic hydrocarbon waxes. Such waxes include polypropylene homopolymers, polyethylene homopolymers, amorphous copolymers of propylene and ethylene or butylene, amorphous copolymers of ethylene and butylenes, semi-crystalline styrene copolymers, semi-crystalline polyolefins which may or may not contain functional groups such as hydroxyl, carboxyl, amino, amido, ester, ether, ammonium and/or halogen. The branched waxes utilized in the process of the present disclosure differ from conventional linear polypropylenes and polyethylenes, which are highly crystalline. Without wishing to be bound by any theory, the branched nature of the waxes utilized in the processes of the present disclosure may help stabilize wax dispersions utilized in forming latex encased wax particles of the present disclosure.

In embodiments, the polyolefin wax may possess branched-chain iso-paraffinic configurations. Examples of such materials include a polyethylene wax having a very high iso-paraffinic (branched) configuration, in embodiments about 70% branching, a molecular weight of about 3,500 (obtained by osmometry), an ASTM D-566 drop point at about 102° C. to about 110° C., a density of about 0.92, and a viscosity at about 150° C. of about 300 to about 380 cps. One commercially available low-density, highly branched polyethylene wax is available from Eastman Chemical Company (Kingsport, Tenn.) under the trade designation EPOLENE® C-10.

In embodiments, branched polyethylene waxes which may be utilized possess a molecular weight (Mw) of from about 100 to about 10,000, in embodiments of from about 200 to about 1,000, an Mn of from about 100 to about 10,000, in embodiments from about 200 to about 1,000, and a melting temperature (Tm) of from about 35° C. to about 200° C., in embodiments from about 45° C. to about 120° C. Branched polypropylene waxes which may be utilized possess a Mw of from about 150 to about 10,000, in embodiments of from about 250 to about 1,000, an Mn of from about 150 to about 10,000, in embodiments from about 250 to about 1,000, and a melting temperature (Tm) of from about 35° C. to about 200° C., in embodiments from about 45° C. to about 120° C.

The viscosities of useful branched polyolefin waxes may be in the range of about 0.01 cps to about 200 cps, in embodiments about 0.5 cps to about 150 cps, at about 190° C., which translates to a theoretical Melt Flow Index of about 0.1 to about 250 g/10 minutes.

In embodiments, the branched polyolefin waxes may be generated by chemical treatment of a linear polyolefin wax. For example, POLYWAX 725, from Baker-Petrolite, is a relatively low and narrow molecular weight polyethylene wax. When contacted with a strong oxidative free radical initiator, like ammonium persulfate, sodium persulfate, potassium persulfate, benzoyl peroxide, methyl ethyl ketone peroxide, cumene hydroperoxide and/or hydrogen peroxide, carbon-hydrogen sites located on the surfaces of the wax particles of such a linear wax may be oxidized to generate free radicals. These free radicals may react with monomers or other wax particles thereby forming copolymer or block polymer chains. The resulting polymer chains may be branched and thus be utilized in the processes of the present disclosure.

In embodiments, the branched waxes may be functionalized. Examples of groups added to functionalize waxes include amines, amides, imides, esters, quaternary amines, and/or carboxylic acids. In embodiments, the functionalized waxes may be included as part of acrylic polymer emulsions, for example, Joncryl 74, 89, 130, 537, and 538, all available from Johnson Diversey, Inc, or chlorinated polypropylenes and polyethylenes commercially available from Allied Chemical and Petrolite Corporation and Johnson Diversey, Inc.

Branched waxes suitable for use in forming particles of the present disclosure include, for example, submicron wax particles in the size range of from about 50 to about 1000 nanometers, in embodiments of from about 100 to about 500 nanometers in volume average diameter. The wax may be in particulate form or may, in embodiments, be in a wax dispersion formed by suspending the wax particles in an aqueous phase of water and optionally an ionic surfactant, nonionic surfactant, or mixtures thereof. Where utilized, an ionic surfactant or nonionic surfactant may be present in an amount of from about 0.5 to about 10 percent by weight, and in embodiments of from about 1 to about 5 percent by weight of the wax.

The wax may be present in the final toner composition in an amount of from about 1 to about 30 percent by weight, and in embodiments from about 2 to about 20 percent by weight of the toner.

In embodiments a branched polyethylene wax may be used as the wax of a copolymer encapsulated wax of the present disclosure.

At least two monomers are utilized to form the copolymer shell over the wax core. Any monomer suitable for preparing a latex emulsion can be used in the present processes to form a copolymer shell over a wax core. At least two may refer, in embodiments, for example, to from about two to about twenty and, in embodiments, from about three to about ten. Suitable monomers useful in forming the latex emulsion include, but are not limited to, styrenes, acrylates, methacrylates, butadienes, isoprenes, acrylic acids, methacrylic acids, acrylonitriles, mixtures thereof, and the like. The particular resin employed may be selected depending upon the particular latex polymer to be made in the emulsion polymerization process.

Illustrative examples of specific latex resin, polymer or polymers that can be prepared as a copolymer shell over a wax core in accordance with the present disclosure include styrene acrylates, styrene butadienes, styrene methacrylates, and more specifically, poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), and poly(acrylonitrile-butyl acrylate-acrylic acid). In addition, polyester resins obtained from the reaction of bisphenol A and propylene oxide or propylene carbonate, and in particular including such polyesters followed by the reaction of the resulting product with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol may also be used.

In embodiments, a poly(styrene-butyl acrylate) may be utilized as the shell latex.

In embodiments, it may be advantageous to include a stabilizer when forming the latex encased wax. Suitable stabilizers include monomers having carboxylic acid functionality. Such stabilizers may be of the following formula (I):

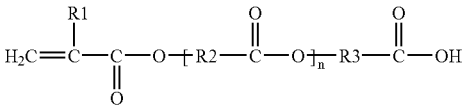

(I)

where R1 is hydrogen or a methyl group; R2 and R3 are independently selected from alkyl groups containing 1 to 12 carbon atoms or a phenyl group; n is from about 0 to about 20, in embodiments from about 1 to about 10. Examples of such stabilizers include beta carboxy ethyl acrylate (β-CEA), poly (2-carboxyethyl)acrylate, 2-carboxyethyl methacrylate, and the like. Other stabilizers which may be utilized include, for example, acrylic acid and its derivatives.

In embodiments, the stabilizer having carboxylic acid functionality may also contain a small amount of metallic ions, such as sodium, potassium and/or calcium, to achieve better emulsion polymerization results. The metallic ions may be present in an amount from about 0.05 to about 5 percent by weight of the stabilizer having carboxylic acid functionality, in embodiments from about 0.8 to about 2 percent by weight of the stabilizer having carboxylic acid functionality.

In embodiments, the wax encapsulated by latex may be prepared in an aqueous phase containing a surfactant or co-surfactant. Surfactants which may be utilized in the latex dispersion can be ionic or nonionic surfactants in an amount of from about 0.01 to about 15, and in embodiments of from about 0.01 to about 5 weight percent of the solids.

Anionic surfactants which may be utilized include sulfates and sulfonates, sodium dodecylsulfate (SDS), sodium dodecylbenzene sulfonate, sodium dodecyinaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., mixtures thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, and C12, C15, C17 trimethyl ammonium bromides, mixtures thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, and the like, and mixtures thereof. In embodiments a suitable cationic surfactant includes SANISOL B-50 available from Kao Corp., which is primarily a benzyl dimethyl alkonium chloride.

Examples of nonionic surfactants include, but are not limited to alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, mixtures thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be selected.

The choice of particular surfactants or combinations thereof as well as the amounts of each to be used are within the purview of those skilled in the art.

In embodiments initiators may be added to the latex for formation of the wax encapsulated by latex particles. Examples of initiators include water soluble initiators, such as ammonium persulfate, sodium persulfate and potassium persulfates, and organic soluble initiators including organic peroxides and azo compounds including Vazo peroxides, such as VAZO 64™, 2-methyl 2-2'-azobis propanenitrile, VAZO 88™, and 2-2'-azobis isobutyramide dehydrate and mixtures thereof. Initiators can be added in suitable amounts, such as from about 0.1 to about 8 weight percent, and in embodiments of from about 0.2 to about 5 weight percent of the monomers.

In embodiments chain transfer agents may be utilized including dodecane thiol, octane thiol, carbon tetrabromide, mixtures thereof, and the like, in amounts from about 0.1 to about 10 percent and, in embodiments, from about 0.2 to about 5 percent by weight of monomers, to control the molecular weight properties of the polymer when emulsion polymerization is conducted in accordance with the present disclosure.

In some embodiments a pH titration agent may be added to control the rate of the emulsion aggregation process. The pH titration agent utilized in the processes of the present disclosure can be any acid or base that does not adversely affect the products being produced. Suitable bases can include metal hydroxides, such as sodium hydroxide, potassium hydroxide, ammonium hydroxide, and optionally mixtures thereof. Suitable acids include nitric acid, sulfuric acid, hydrochloric acid, citric acid, acetic acid, and optionally mixtures thereof.

In the emulsion aggregation process, the reactants are added to a suitable reactor, such as a mixing vessel. The appropriate amount of wax, at least two monomers, stabilizer, surfactant(s), initiator, if any, chain transfer agent, if any, and the like are combined in the reactor and the emulsion aggregation process is allowed to begin. Reaction conditions selected for effecting the emulsion polymerization of the monomers in the presence of wax include temperatures ranging, for example, from about 45° C. to about 120° C., in embodiments about 60° C. to about 90° C. In embodiments the polymerization may occur at elevated temperatures within 10 percent of the melting point of the wax, for example from about 60° C. to about 85° C., in embodiments from about 65° C. to about 80° C. to, for example, permit the wax to soften thereby promoting dispersion and incorporation into the emulsion.

The processes of the present disclosure encapsulate dispersed wax particles within a copolymer shell to form nanometer size particles, from about 50 nm to about 800 nm in diameter, in embodiments from about 100 nm to about 400 nm in volume average diameter as determined, for example, by a Brookhaven nanosize particle analyzer. The core of the particle is a wax and the shell of the particle is an emulsion polymerized latex resin. The nano-encapsulation of the wax by the latex can help stabilize the wax dispersion because the wax may chemically bond with the polymeric resin in the shell latex.

The resulting particles of the present disclosure may possess a wax core of from about 1 percent to about 30 percent, in embodiments about 5 to about 20 percent by weight of the wax/latex particle. Conversely, the wax/latex particle may possess a copolymer shell of from about 70 to about 99 percent, in embodiments about 80 to about 95 percent, by weight of the wax/latex particle, with the total combined weight of the wax and latex being about 100 percent. The amount of wax and latex may be varied depending upon the desired toner.

The polymer shell possesses a suitable thickness of, for example, about 0.01 microns to about 2 microns, and in embodiments from about 0.1 microns to about 1 micron.

After formation of the latex encased wax particles, the latex encased wax particles may be utilized to form a toner in accordance with the present disclosure. In embodiments, the toners are an emulsion aggregation type toner that are prepared by the aggregation and fusion of the wax/latex particles of the present disclosure with a colorant, and one or more additives such as surfactants, coagulants, waxes, surface additives, and optionally mixtures thereof.

The latex encased wax particles may be added to a colorant dispersion. The colorant dispersion includes, for example, submicron colorant particles in a size range of, for example, from about 50 to about 500 nanometers and, in embodiments, of from about 100 to about 400 nanometers in volume average diameter. The colorant particles may be suspended in an aqueous water phase containing an anionic surfactant, a nonionic surfactant, or mixtures thereof. In embodiments, the surfactant may be ionic and is from about 1 to about 25 percent by weight, and in embodiments from about 4 to about 15 percent by weight of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet or mixtures thereof.

In embodiments wherein the colorant is a pigment, the pigment may be, for example, carbon black, phthalocyanines, quinacridones or RHODAMINE B™ type, red, green, orange, brown, violet, yellow, fluorescent colorants and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido) phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, Cl Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 20 weight percent of the toner.

The resultant blend of copolymer encapsulated wax, optionally in a dispersion, and colorant dispersion may be stirred and heated to a temperature of from about 45° C. to about 65° C., in embodiments of from about 48° C. to about 63° C., resulting in toner aggregates of from about 3 microns to about 15 microns in volume average diameter, and in embodiments of from about 5 microns to about 8 microns in volume average diameter.

In embodiments, a coagulant may be added during or prior to aggregating the latex encased wax and the aqueous colorant dispersion. The coagulant may be added over a period of time from about 1 to about 20 minutes, in embodiments from about 1.25 to about 8 minutes, depending on the processing conditions.

Examples of coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to be of the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.02 to about 2 percent by weight of the toner, and in embodiments from about 0.1 to about 1.5 percent by weight of the toner.

Any aggregating agent capable of causing complexation might be used in forming toner of the present disclosure. Both alkali earth metal or transition metal salts can be utilized as aggregating agents. In embodiments, alkali (II) salts can be selected to aggregate sodio sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally mixtures thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, mixtures thereof, and the like.

Stabilizers that may be utilized in the toner formulation processes include bases such as metal hydroxides, including sodium hydroxide, potassium hydroxide, ammonium hydroxide, and optionally mixtures thereof. Also useful as a stabilizer is a composition containing sodium silicate dissolved in sodium hydroxide.

The toner may also include charge additives in effective amounts of, for example, from about 0.1 to about 10 weight percent, in embodiments from about 0.5 to about 7 weight percent. Suitable charge additives include alkyl pyridinium halides, bisulfates, the charge control additives of U.S. Pat. Nos. 3,944,493; 4,007,293; 4,079,014; 4,394,430 and 4,560,635, the entire disclosures of each of which are hereby incorporated by reference in their entirety, negative charge enhancing additives like aluminum complexes, any other charge additives, mixtures thereof, and the like.

Further optional additives include any additive to enhance the properties of toner compositions. Included are surface additives, color enhancers, etc. Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 10 weight percent, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be selected in amounts, for example, of from about 0.05 to about 5 percent by weight, in embodiments from about 0.1 to about 2 percent by weight of the toner, which additives can be added during the aggregation or blended into the formed toner product.

Once the desired final size of the toner particles is achieved with a volume average diameter of from about 5 microns to about 7 microns, and in embodiments of from about 5.3 microns to about 6.5 microns, the pH of the mixture may be adjusted with a base to a value of from about 5 to about 7, and in embodiments from about 6 to about 6.8. The base may include any suitable base such as, for example, alkali metal hydroxides such as, for example, sodium hydroxide, potassium hydroxide, and ammonium hydroxide. The alkali metal hydroxide may be added in amounts from about 6 to about 25 percent by weight of the mixture, in embodiments from about 10 to about 20 percent by weight of the mixture.

The mixture is subsequently coalesced. Coalescing may include stirring and heating at a temperature of from about 90° C. to about 99° C., for a period of from about 0.5 to about 12 hours, and in embodiments from about 2 to about 6 hours. Coalescing may be accelerated by additional stirring.

In accordance with the present disclosure, after the addition of shell latex, the wax is dispersed in the core of the copolymer encapsulated wax particle, with the resin from the shell latex comprising the outer layer of the copolymer encapsulated wax particle. After combining with colorant, upon heating to near the peak melting point of the wax during coalescence, wax trapped in the core of the copolymer encapsulated wax particle will slowly migrate into the shell of the toner particle, but does not protrude from the surface of the toner particles. In this migration, low molecular weight wax will come out first from the core.

The pH of the mixture is then lowered to from about 3.5 to about 6 and in embodiments, to from about 3.7 to about 5.5 with, for example, an acid to coalesce the toner aggregates. Suitable acids include, for example, nitric acid, sulfuric acid, hydrochloric acid, citric acid or acetic acid. The amount of acid added may be from about 4 to about 30 percent by weight of the mixture, and in embodiments from about 5 to about 15 percent by weight of the mixture.

The mixture is cooled, washed and dried. Cooling may be at a temperature of from about 20° C. to about 40° C., in embodiments from about 22° C. to about 30° C. over a period time from about 1 hour to about 8 hours, and in embodiments from about 1.5 hours to about 5 hours.

In embodiments, cooling a coalesced toner slurry includes quenching by adding a cooling media such as, for example, ice, dry ice and the like, to effect rapid cooling to a temperature of from about 20° C. to about 40° C., and in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture is not feasible nor practical, neither by the introduction of a cooling medium into the toner mixture, nor by the use of jacketed reactor cooling.

The washing may be carried out at a pH of from about 7 to about 12, and in embodiments at a pH of from about 9 to about 11. The washing is at a temperature of from about 45° C. to about 70° C., and in embodiments from about 50° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying is typically carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

The toner compositions generated in embodiments of the present disclosure include, for example, particles with a volume average diameter of from about 5 microns to about 7 microns, and in embodiments of from about 5.5 microns to about 6.5 microns, in an amount of from about 12% to about 25%, and in embodiments of from about 14% to about 18% by weight of the total toner composition.

The toner of the present disclosure may have particles with a circularity of from about 0.93 to about 0.99, and in embodiments of from about 0.94 to about 0.98. When the spherical toner particles have a circularity in this range, the spherical toner particles remaining on the surface of the image holding member pass between the contacting portions of the imaging holding member and the contact charger, the amount of deformed toner is small, and therefore generation of toner filming can be prevented so that a stable image quality without defects can be obtained over a long period.

The copolymer encapsulated wax particles of the present disclosure may generally be present in the toner composition of from about 75 weight percent to about 98 weight percent, and in embodiments from about 80 weight percent to about 95 weight percent of the toner or the solids of the toner. The expression solids can refer, in embodiments, to the latex, wax, colorant, and any other optional additives of the toner composition.

Figure 2:
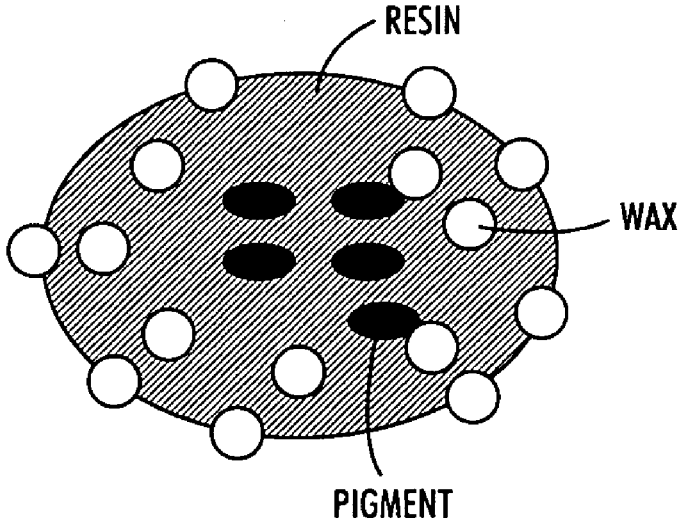
FIG. 2 (Prior Art)
FIG. 2 schematically shows toner particles produced by current methods, having wax at the surface of the particle where it can interfere with formation of toner particles.

Using the copolymer encapsulated wax particles in the aggregation/coalescence process, the resulting toner particles have the structure as depicted in FIG. 1, compared with the current toner particle structure illustrated in FIG. 2. As can be seen in FIG. 1, toner particles of the present disclosure possess wax particles in an ideal location, that is, their shell, compared with current toner particles, which have wax at the core and protruding from the surface as depicted in FIG. 2. Toner particles of the present disclosure possessing wax particles in the shell retain their ability to function during the fusing process, and problems associated with wax protruding from the particles are avoided, including low toner flowing and transferring problems.

Process times for producing toner in accordance with the present disclosure may be reduced compared with conventional processes. For example, in embodiments, toner may be produced with the copolymer encapsulated wax particles in accordance with the present disclosure over a time period of from about 4 hours to about 10 hours, in embodiments from about 5 hours to about 7 hours, compared with toners produced with conventional materials utilizing the same operating conditions, which may take about 12 hours. Moreover, the processes of the present disclosure may be utilized on existing EA toner production lines using existing equipment, and therefore do not incur additional costs associated with reconfiguring the production line.

Toner in accordance with the present disclosure can be used in a variety of imaging devices including printers, copy machines, and the like. The toners generated in accordance with the present disclosure are excellent for imaging processes, especially xerographic processes, which may operate with a toner transfer efficiency in excess of about 90 percent, such as those with a compact machine design without a cleaner or those that are designed to provide high quality colored images with excellent image resolution, acceptable signal-to-noise ratio, and image uniformity. Further, toners of the present disclosure can be selected for electrophotographic imaging and printing processes such as digital imaging systems and processes.

The imaging process includes the generation of an image in an electronic printing apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light and developing the resulting latent electrostatic image by depositing on the image a finely-divided electroscopic material referred to in the art as "toner". The toner will normally be attracted to the discharged areas of the layer, thereby forming a toner image corresponding to the latent electrostatic image. This powder image may then be transferred to a support surface such as paper. The transferred image may subsequently be permanently affixed to the support surface as by heat.

Developer compositions can be prepared by mixing the toners obtained with the embodiments of the present disclosure with known carrier particles, including coated carriers, such as steel, ferrites, and the like. See, for example, U.S. Pat. Nos. 4,937,166 and 4,935,326, the disclosures of each of which are hereby incorporated by reference in their entirety. The toner-to-carrier mass ratio of such developers may be from about 2 to about 20 percent, and in embodiments from about 2.5 to about 5 percent of the developer composition. The carrier particles can include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, mixtures thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer comprises conductive carrier particles and is capable of conducting an electric current between the biased magnet through the carrier particles to the photoreceptor.

Imaging methods are also envisioned with the toners disclosed herein. Such methods include, for example, some of the above patents mentioned above and U.S. Pat. Nos. 4,265,990, 4,858,884, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

Synthesis of shell latex with wax core. A monomer mixture was first prepared by combining about 5.35 grams of DOWFAX® 2A1 (an anionic surfactant of alkyldiphenyloxide disulfonate salts), about 128.2 grams of deionized water, about 206.8 grams of styrene monomer, about 63.5 grams of butyl acrylate monomer, about 8.11 grams of β-carboxyethyl acrylate, about 0.95 gram of alkanediol diacrylate, and about 1.9 grams of 1-dodecanethiol were mixed in an 800 ml beaker with stirring at about 600 revolutions per minute (rpm) for about 30 minutes. The stirring was stopped for about 5 minutes and a two-layer solution was observed.

The mixture was then stirred at about 600 rpm for about 10 minutes. After the stirring was stopped for about 5 minutes, a partially phase-separated mixture was obtained. The mixture was then stirred at about 600 rpm again for about 30 minutes. A stable milky solution (emulsion), referred to herein as Mixture 1, was obtained.

To a 2000 ml three-necked flask with dented wall, to which was attached a water-cooling condenser, thermometer, mechanical stirrer, and nitrogen gas inlet, about 0.4 grams of DOWFAX® 2A1 surfactant, about 368.7 grams of POLYWAX® 725 polyethylene wax (Baker Petrolite, USA), and about 257 grams of deionized water were charged. The mixture was stirred at about 325 rpm and the temperature was raised to about 75° C. over a period of about 1.5 hours. Then, about 45 ml of Mixture 1 was added through an addition pump over a period of about 30 minutes. Immediately after the addition of Mixture 1, an initiator solution including about 4.05 grams of ammonium persulfate in about 20.1 grams of deionized water was added through the addition pump over a period of about 20 minutes. About 30 minutes after the addition of the initiator solution, about 370 ml of Mixture 1 was mixed with about 2.25 grams of 1-dodecanethiol and the combination of the two was then added to the flask through the addition pump over a period of about 3 hours. At the end of this addition, about 10 ml of deionized water was used to rinse the pump and then added to the reaction flask. The reaction mixture was then stirred at about 350 rpm at about 75° C. for about 3 hours. The reaction was stopped by natural cooling in the hood over a period of about 2 hours. A very stable milky solution was obtained, which included wax core/shell latex particles.

The volume average size of the resulting core-shell latex (wax core, copolymer shell) particles as determined by Micro Trac Particle Size Analyzer (Microtrac Inc., Montgomeryville, Pa.) was about 200 nanometers. The solid content of this core-shell latex as determined gravimetrically was about 47.3 wt %.

No wax flakes separated out from this latex during synthesis and a narrow nanometer particle size distribution was achieved indicating that the wax particles are contained inside. The stable wax core/shell latex emulsion was subsequently used as the shell material in preparing EA toner particles.

Example 2

Preparation of toner with wax core/shell latex. In a 2000-ml reactor, about 296.4 grams of a latex (polystyrene-co-n-butyl acrylate-co-βCEA), about 49.8 grams of REGAL 330® pigment dispersion (a black pigment from Cabot Corp.), and about 630.8 grams of deionized water were mixed by a homogenizer for about 15 minutes at about 20° C. Next, about 3.6 grams of polyaluminum chloride (from Asada Kagaku Kogyo Co.) in about 33 grams of about 0.02 N nitric acid was added dropwise over a period of about eight minutes. The resulting viscous mixture was continuously mixed by the homogenizer for about 20 minutes. Then the mixture was stirred by a mechanical stirrer at about 350 rpm, and the temperature of the mixture was raised to about 60° C. over a period of about 35 minutes.

After the mixture was stirred at about 60° C. for about 15 additional minutes, about 180.6 grams of the wax core/shell latex (synthesized as in Example 1 above) and about 22.4 grams of latex EA-12-106 were added through a flow meter over a period of about 35 minutes. After the addition was complete, the mixture was stirred at about 200 rpm for about 2 hours. The pH value of this solution was adjusted to about 6.3 using about 4% by weight sodium hydroxide solution. Then the temperature of the mixture was raised to about 96° C. over a period of about 35 minutes and the pH was adjusted immediately to about 4.0 using about 0.3N nitric acid solution. After stirring at about 96° C. for about 75 minutes, the mixture was cooled down to about 66° C. and the pH was adjusted to about 10.0 using the about 4% by weight sodium hydroxide solution, as the temperature decreased to about 20° C. After washing with about 6000 ml of deionized water and drying at about 65° C., the final toner product had a volume median particle size of about 6.76 micrometers, with a circularity of about 0.979 as determined by a Sysmex FPIA-2100 (from Malvern Instruments).

Example 3

A multi point BET (Brunauer, Emmett, Teller) method employing nitrogen as the adsorbate was used to determine the surface area of one sample of toner particles produced in accordance with Example 2. Approximately one gram of the sample was accurately weighed into a BET tube. The sample was degassed using flowing nitrogen at about 30° C. on a VacPrep 061 (available from Micromeritics of Norcross, Ga.) overnight prior to analysis. The multi point surface area was determined using nitrogen as the adsorbate gas at about 77 Kelvin ($LN_2$), over the relative pressure range of about 0.15 to about 0.30. The cross-sectional area of the nitrogen adsorbate used in the calculation was about 16.2 square angstroms. The single point BET data was also reported and was calculated at a relative pressure of approximately 0.30. The sample was analyzed on a Micromeritics Tristar 3000 (Norcross, Ga.). The results of the BET data are summarized below in Table 1:

TABLE 1

| SAMPLE ID | Multipoint Nitrogen Surface Area $m^2/g$ | Single point Nitrogen Surface Area $m^2/g$ |
|---|---|---|
| 1 | 1.80 | 1.67 |

A scanning electron micrograph of the toner was obtained utilizing a JEOL JSM-6400 manufactured by JEOL Corporation, Tokyo, Japan. The SEM results showed that toner particles made in accordance with the present disclosure had a very smooth surface.

Using the process of the present disclosure, the above lab scale emulsion aggregation experiment took only about 7 hours to generate toner particles. The obtained toner particles possessed a circularity of about 0.979 and a particle size of about 6.76 micrometers. Thus, the processes of the present disclosure could reduce process cycle time and increase process robustness.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner comprising a colorant, optionally one or more components selected from the group consisting of surfactants, coagulants, waxes, surface additives, and optionally mixtures thereof, and copolymer encapsulated wax particles formed by contacting a wax dispersion, at least two monomers, a surfactant, and a stabilizer of the following formula:

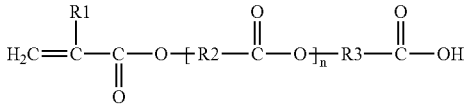

(I)

where R1 is hydrogen or methyl group; R2 and R3 are independently selected from alkyl groups containing about 1 to about 12 carbon atoms and a phenyl group; and n is from about 0 to about 20;

forming copolymer encapsulated wax particles by emulsion polymerization of the at least two monomers to form a copolymer shell around a branched wax core; and, recovering the copolymer encapsulated wax particles, wherein the wax in the wax dispersion possesses side chains.

2. A process comprising:

contacting a wax dispersion, at least two monomers, a surfactant, and a stabilizer of the following formula:

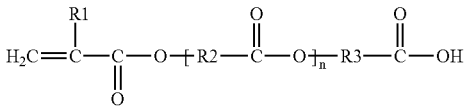

(I)

where R1 is hydrogen or methyl group; R2 and R3 are independently selected from alkyl groups containing 1 to 12 carbon atoms and a phenyl group; and n is from about 0 to about 20;

forming copolymer encapsulated wax particles by emulsion polymerization of the monomer to form a copolymer shell around a branched wax core;

recovering the copolymer encapsulated wax particles;

aggregating the copolymer encapsulated wax particles with a colorant and optionally one or more components selected from the group consisting of surfactants, coagulants, waxes, surface additives, and optionally mixtures thereof to form aggregated toner particles;

coalescing the aggregated toner particles to form aggregated and coalesced toner particles; and washing the aggregated and coalesced toner particles to form toner, wherein the wax in the wax dispersion possesses side chains.

3. The process of claim 2, wherein the wax is selected from the group consisting of branched polyolefins, branched vegetable waxes, branched animal waxes, branched mineral waxes and branched synthetic waxes, the monomer is selected from the group consisting of styrenes, acrylates, methacrylates, butadienes, isoprenes, acrylic acids, methacrylic acids, acrylonitriles, and mixtures thereof, and the colorant is selected from the group consisting of pigments, dyes, mixtures of pigments and dyes, mixtures of pigments, and mixtures of dyes.

4. The process of claim 2, wherein the wax is selected from the group consisting of polypropylene homopolymers, polyethylene homopolymers, amorphous copolymers of propylene and ethylene, amorphous copolymers of propylene and butylene, amorphous copolymers of ethylene and butylenes, semi-crystalline styrene copolymers, and semi-crystalline polyolefins optionally functionalized with a group selected from the group consisting of hydroxyl, carboxyl, amino, amido, ester, ether, ammonium, halogen, and combinations thereof, and the latex is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), and poly(acrylonitrile-butyl acrylate-acrylic acid).

5. The process of claim 2, wherein the stabilizer is selected from the group consisting of beta carboxy ethyl acrylate, poly(2-carboxyethyl) acrylate, and 2-carboxyethyl methacrylate.

6. The process of claim 2, wherein the surfactant is selected from the group consisting of anionic surfactants, cationic surfactants and nonionic surfactants.

7. The process of claim 2, wherein the toner particles have a size from about 4.5 to about 8 microns and a circularity from about 0.94 to about 0.98.

8. The toner of claim 1, wherein the toner particles have a volume average diameter from about 5 to about 7 microns and a circularity from about 0.93 to about 0.99.

* * * * *